US010533369B2

(12) United States Patent
Dintheer et al.

(10) Patent No.: US 10,533,369 B2
(45) Date of Patent: Jan. 14, 2020

(54) SEAL FOR A SILL-FREE DOOR

(71) Applicant: Planet GDZ AG, Tagelswangen (CH)

(72) Inventors: Andreas Dintheer, Illnau (CH); Jochen Schaar, Dietlikon (CH)

(73) Assignee: PLANET GDZ AG, Tagelswangen (CH)

( * ) Notice: Subject to any disclaimer, the term of this patent is extended or adjusted under 35 U.S.C. 154(b) by 10 days.

(21) Appl. No.: 15/543,024

(22) PCT Filed: Jan. 5, 2016

(86) PCT No.: PCT/EP2016/050072
§ 371 (c)(1),
(2) Date: Jul. 12, 2017

(87) PCT Pub. No.: WO2016/113149
PCT Pub. Date: Jul. 21, 2016

(65) Prior Publication Data

US 2018/0002976 A1 Jan. 4, 2018

(30) Foreign Application Priority Data

Jan. 15, 2015 (EP) ..... 15151330

(51) Int. Cl.
*E06B 7/21* (2006.01)
*E06B 7/18* (2006.01)

(52) U.S. Cl.
CPC . *E06B 7/21* (2013.01); *E06B 7/18* (2013.01)

(58) Field of Classification Search
CPC ..... E06B 7/18; E06B 7/21; E06B 7/215
See application file for complete search history.

(56) References Cited

U.S. PATENT DOCUMENTS 3,374,821 A * 3/1968 White ..... E05D 15/063 160/206
3,453,780 A * 7/1969 Thompson ..... E06B 7/18 49/482.1

(Continued)

FOREIGN PATENT DOCUMENTS

DE 29720854 U1 4/1999
DE 20208182 U1 10/2003

(Continued)

*Primary Examiner* — Justin B Rephann
(74) *Attorney, Agent, or Firm* — Browdy and Neimark, P.L.L.C.

(57) ABSTRACT

A seal for a sill-free door for sealing a gap between a door leaf and a floor has a carrier rail (2) and a sealing profile (3) retained on the carrier rail (2). The sealing profile (3) has a substantially u-shaped cross section with two limbs (30) and a sealing crosspiece (32), which connects the two limbs (30) to one another and is intended for bearing with sealing action on the floor. There is a cavity (37) present, said cavity being defined by an underside (23) of the carrier rail (2), by the limbs (30) and by the sealing crosspiece (32), wherein the sealing profile (3), on each limb (30), has at least one strip (34) which is arranged on an inner side of the limb (30), projects into the cavity and is intended for improving the sound insulation. At least two strips (34) have a thickness which is greater than the thickness of the adjacent region of the limb (30). Said seal has optimized sound insulation.

14 Claims, 3 Drawing Sheets

(56) References Cited

U.S. PATENT DOCUMENTS

| | | | | |
|---|---|---|---|---|
| 4,406,088 | A * | 9/1983 | Berndt, Jr. | E06B 7/215 49/309 |
| 4,805,345 | A * | 2/1989 | Ohi | E06B 7/215 49/308 |
| 6,125,584 | A * | 10/2000 | Sanders | E06B 7/215 49/310 |
| 8,336,257 | B2 * | 12/2012 | McDonald | E04B 1/043 49/303 |
| 2004/0010973 | A1 * | 1/2004 | Lio | E06B 7/20 49/306 |
| 2004/0111972 | A1 * | 6/2004 | Dintheer | E06B 7/215 49/470 |
| 2007/0022663 | A1 * | 2/2007 | Faflek | E05C 19/16 49/306 |
| 2013/0219792 | A1 * | 8/2013 | Parker | E06B 7/21 49/306 |
| 2015/0121759 | A1 * | 5/2015 | Dintheer | E06B 7/02 49/70 |
| 2017/0306692 | A1 * | 10/2017 | Meng | E06B 7/21 |
| 2018/0291674 | A1 * | 10/2018 | Dintheer | E06B 7/215 |

FOREIGN PATENT DOCUMENTS

| | | | |
|---|---|---|---|
| EP | 0338974 | A2 | 10/1989 |
| EP | 0841457 | A1 | 5/1998 |
| EP | 1233137 | A2 | 8/2002 |
| EP | 2554774 | A1 | 2/2013 |

* cited by examiner

FIG. 1
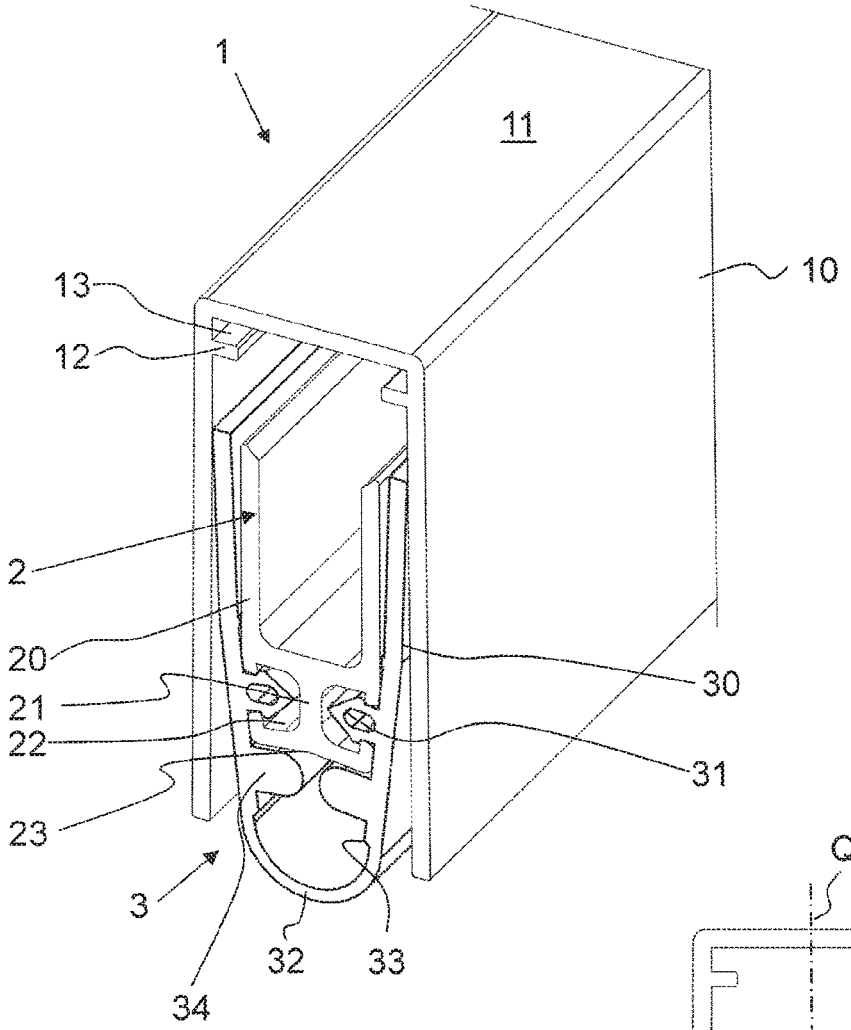
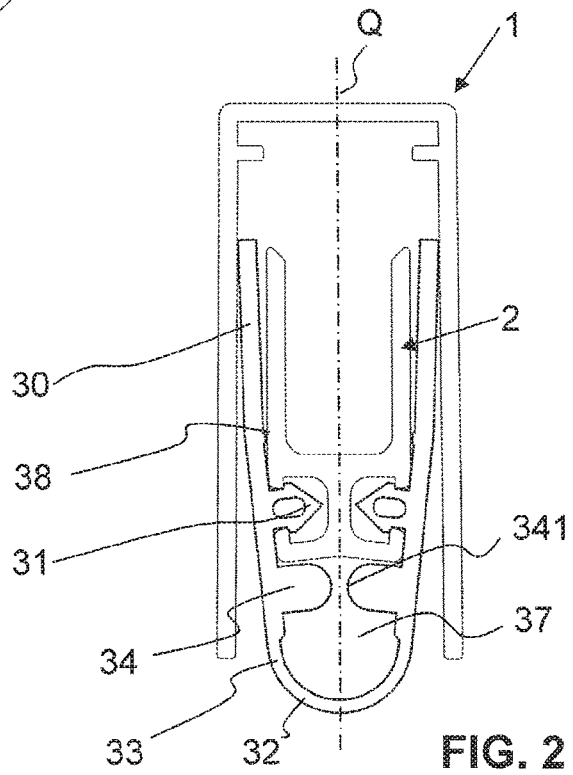
FIG. 2

SEAL FOR A SILL-FREE DOOR

TECHNICAL FIELD

The present invention relates to a seal for a sill-free door.

PRIOR ART

Door seals for sealing a lower end surface of a sill-free door are known. They are intended to prevent the passage of light and also to provide sound insulation. Depending on the embodiment, the passage of air is also to be avoided.

EP 0 338 974 discloses a drop-down door seal with a u-shaped housing rail and a sealing bar with a carrier profile and a u-shaped elastomeric sealing profile. The sealing bar is held in the housing rail such that it can be automatically raised and lowered, the movement being effected relative to the housing rail. The sealing profile comprises two legs and a curved sealing crosspiece, which connects said two legs and, with the sealing bar in the lowered state, rests with sealing action on the floor. The sealing profile is fastened on either side of the carrier rail. Said seal has proven successful in practice.

EP 2 554 774 discloses a similar seal, the fastening of the sealing profile on either side of the carrier rail being effected at different heights.

EP 0 841 457 describes a v-shaped sealing profile of a drop-down door seal, said profile comprising two downwardly directed feet and abutments, which are directed inward into a cavity and on which the carrier profile rests.

Various solutions which are intended to optimize the sound insulation are proposed in the prior art. Thus, DE 297 20 854 U discloses a sealing profile with a cavity in which a steel rod is positioned.

EP 1 233 137 proposes various means for improving the sound insulation, some of which are arranged on the inner sides of the legs and project into a cavity which is formed by the two legs and the sealing crosspiece of the sealing profile.

DESCRIPTION OF THE INVENTION

It is consequently an object of the invention to create a seal which is intended for a sill-free door and exhibits improved sound insulation.

The seal according to the invention for a sill-free door for sealing a gap between a door leaf and a floor comprises a carrier rail and a sealing profile which is held on the carrier rail. The sealing profile comprises a substantially u-shaped cross section with two legs and a sealing crosspiece, which connects the two legs together and is intended for resting with sealing action on the floor. A cavity is present and is defined by an underside of the carrier rail, the legs and the sealing crosspiece, wherein the sealing profile comprises, on each leg, at least one strip, which is arranged on an inner side of the leg and projects into the cavity, for the purpose of improving sound insulation. According to the invention, at least two strips have a thickness which is greater than the thickness of the adjacent region of the leg.

The thickness of the strip is to be understood here as the extent parallel to the transverse center axis. The thickness is consequently the height of the strip. The length of the strip is the extent transverse to the transverse center axis, and transverse to the longitudinal center axis, of the seal. The thickness of the leg is the wall thickness of the leg and is consequently the extent which runs at an angle to the transverse center axis, and transverse to the longitudinal center axis, of the seal.

These two relatively thick strips are preferably situated on each of the legs. They are preferably situated more or less at the same height of the legs. Said strips are preferably more or less twice as thick, or more than twice as thick, as the adjacent region of the leg on which they are mounted. The two legs are preferably of the same thickness.

The at least one strip preferably extends over the entire length of the sealing profile, preferably without any interruptions. It preferably comprises the same cross section over the entire length of the sealing profile.

Surprisingly, in the test room, this shape exhibits very good sound-insulation values, which differ significantly from the seals used up to now. This is the case in particular when the seal is an automatic drop-down seal with a known spring-loaded drop-down mechanism. Typical measured sound-insulation values are between 54 and 56 dB, compared to between 46 and 50 dB for the known seals. Doors with straightforward seals usually comprise sound-insulation values of approximately 27 dB. Sound-insulation values of brick walls are typically approximately 55 dB. The higher the measured value, the better the sound insulation.

The given values are achieved, in particular, in the case of seals as are described in general terms hereinbelow and, in particular, as are described in detail hereinbelow and are disclosed in embodiments illustrated in the figures.

At least one of the strips is preferably spaced apart from the underside of the carrier rail. All the strips are preferably spaced apart from said underside. This relates to the raised or non-loaded state of the seal. If the seal has been lowered, or if it rests with sealing action on the floor, the sealing profile has thus usually been displaced laterally, as seen in relation to the carrier rail, out of its symmetry along the longitudinal center axis. In this displaced state, one strip can usually butt against the underside of the carrier rail, the distance between the other strip and the underside having been increased.

Two of the at least two strips are preferably arranged in the upper region of the cavity, i.e. adjacent to the underside of the carrier rail. They are preferably situated at least in the upper half of the cavity.

Precisely one strip is preferably arranged on each leg. The strip can be arranged in a connecting region of the sealing crosspiece. In a preferred embodiment, however, it is spaced apart from the connecting region of the sealing crosspiece.

In a preferred embodiment, strips arranged on different legs are arranged in a mirror-symmetrical manner with respect to one another along a transverse center axis of the seal, wherein they are designed in a mirror-symmetrical manner with respect to one another along said transverse center axis. The entire sealing profile, or the entire sealing bar including the carrier profile, or the entire seal is preferably of mirror-symmetrical design with respect to the transverse center axis. It is also possible, however, for the sealing profile to be offset in height, as is the case in EP 2 554 774. The offsetting can relate only to the fastening of the sealing profile on the carrier rail and/or it can relate to the arrangement of the strips. The offset arrangement of individual parts allows an optimally narrow configuration of the seal.

In a preferred embodiment, at least one of the strips terminates at a distance from the transverse center axis of the seal. Preferably all the strips arranged on the legs terminate at a distance from one another. The advantage of this embodiment is that the sealing crosspiece can still be optimally adapted in shape when it butts against the floor. In particular, it can reduce the size of the cavity in a practically unobstructed manner. It is also the case that the lateral movement of the legs, which is optimum for lateral sealing, is not obstructed to an overly pronounced extent.

In a preferred embodiment, the sealing crosspiece is designed to be thinner than a region of the legs which is adjacent to the strips.

Optimized sound-insulation values are achieved when the at least one strip extends at an angle of 80°-100° with respect to the transverse center axis of the seal.

Further optimization of the sound-insulation values is achieved when at least one of the strips comprises a substantially rectangular cross section, wherein one side of the rectangle is curved in the form of part of a circle, and wherein said side forms a free end of the strip, said free end projecting into the cavity.

At least one of the strips can be of hollow or solid design. Solid is to be understood here in the sense of "filled".

In order to obtain optimum deformation of the sealing crosspiece and to optimize the sound insulation further, the outer side of the sealing crosspiece is preferably free of protrusions or ribs which are directed downward in the direction of the floor.

The sealing crosspiece is preferably of curved design in order, once again, to optimize deformation, to increase the bearing surface and consequently to optimize the sound insulation.

In preferred embodiments, the two legs merge into the sealing crosspiece by way of a tapering step in each case. In other embodiments, the transition region tapers in a stepless manner. In addition, it is possible for the legs to taper, in turn, in the region which is directed away from the sealing crosspiece, in which case the tapering can also take place in a stepped or stepless manner.

In a preferred embodiment, only the at least one strip is situated in the cavity. In preferred embodiments, only two strips, each arranged on one leg, are situated in the cavity.

In further embodiments, at least one partitioning element, which projects inward into the cavity, is arranged on the sealing crosspiece. The partitioning element is preferably at least one upwardly projecting rib which is preferably designed to be thinner than the at least one strip. In other embodiments, the partitioning element is an angled crosspiece with two ends and two angles, wherein the two ends are arranged on the sealing crosspiece at a distance from one another. Said partitioning elements improve the sound insulation in addition. Depending on the embodiment, with the seal in the lowered state or resting with sealing action on the floor, the positioning elements establish contact with the strips or they establish contact with one another. In other exemplary embodiments, it is also the case in this state that they are spaced apart from one another and/or are spaced apart from the strips.

The elastomeric sealing profile is preferably formed in one piece. Its basic shape preferably corresponds to the proven profile according to EP 0 338 974. It preferably comprises a substantially u-shaped cross section, wherein with the two preferably identically long legs and the sealing crosspiece, which connects the two legs. The sealing crosspiece is of preferably curved design. The two legs are directed upward and preferably each comprise a free end. The legs, preferably their free ends, butt with sliding action against the inner side of the housing rail.

The seal may be a sliding seal. In a preferred embodiment, the seal also comprises a housing rail, in which the carrier rail and the sealing profile are held, these together forming a sealing bar.

The seal is preferably a manually lowerable and raisable seal and, even more preferably, it is a seal which can be lowered and raised automatically in a mechanical manner. In a preferred embodiment, the sealing bar is held in the housing rail such that it can be lowered and raised relative to the housing rail. The actuating mechanism is preferably of known type, in particular it can be activated on one side. In particular, it is spring-loaded.

Further embodiments are given in the dependent claims.

BRIEF DESCRIPTION OF THE DRAWINGS

Preferred embodiments of the invention are described hereinbelow by way of the drawings, which serve purely for explanatory purposes and are not to be interpreted as being restrictive. In the drawings:

FIG. 1 shows a perspective illustration of a first embodiment of a seal according to the invention;

FIG. 2 shows a view of the seal according to FIG. 1;

DESCRIPTION OF PREFERRED EMBODIMENTS

Figure 7:
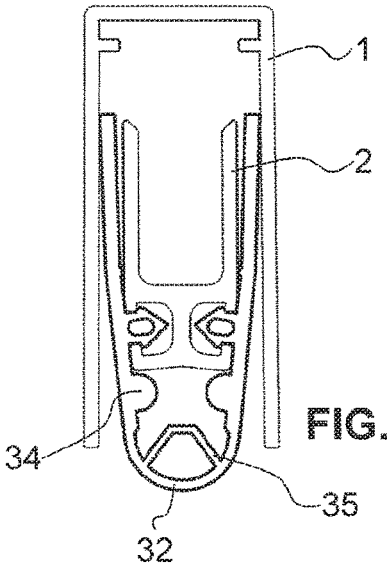
FIG. 7 shows a view of a sixth embodiment of a seal according to the invention.

The exemplary embodiments described here are automatically actuatable drop-down seals. The actuating or lowering mechanism is not illustrated. It is, however, well known in the prior art.

FIGS. 1 and 2 illustrate a first exemplary embodiment of the seal according to the invention. The seal comprises a u-shaped housing rail 1 which is designed to be open in the downward direction and in which a sealing bar 2, 3 is arranged. The sealing bar comprises a carrier rail 2 and an elastomeric sealing profile 3 fastened thereon. The housing rail 1 and the carrier rail 2 are produced preferably from aluminum. The sealing profile 3 consists preferably of silicone or rubber.

The housing rail 1 comprises two side walls 10 which run parallel to one another and are connected together by means of an upper crosspiece 11. Adjacent to the upper crosspiece 11, an inwardly projecting protrusion 12, which extends parallel to the upper crosspiece 10 preferably over the entire length of the housing rail 1, is present on the inner sides of the two side walls 10. A slide or force-transmitting rod (not illustrated), by means of which an external triggering force which acts on an actuating rod is transmitted to leaf springs of the lowering mechanism, is held in the groove 13 which is formed between the upper crosspiece 10 and the protrusions 12. Said elements are well known, for example from EP 0 509 961 and DE 19 516 530, and are not illustrated here.

The carrier rail 2 comprises a fastening body 21 with two laterally arranged receiving grooves 22. The receiving grooves 22 are designed to be open toward the side and are undercut. They, or at least their receiving openings, slope preferably slightly downward toward the open end of the housing rail 1. In other words, the receiving openings slope toward a transverse center axis Q of the seal, said angle being relatively small.

The fastening body 21 comprises an underside 23 which is of preferably flat design, that is to say it does not comprise any protrusions or indentations. The underside 23 is preferably designed to slope slightly toward the transverse center axis Q of the seal, wherein it slopes outward and downward.

In addition, two side walls 20 extend upward from the fastening body 21. The two side walls 20 form a u-shaped groove which is open in the upward direction and in which the lowering mechanism can extend.

The sealing profile 3 is of u-shaped design. It comprises two legs 30 and a sealing crosspiece 32, which connects said legs 30. The two legs 30 are designed to terminate freely in the upward direction. When the seal is being lowered, they butt with sliding action against the inner sides of the side walls 10 of the housing rail 1 and, in the lowered state, they provide lateral sealing, as can easily be seen in FIG. 2. The legs 30, as illustrated here, are preferably not connected to the carrier rail 2 at their free ends. The legs 30 can run in a straight line or, as illustrated here, can bend slightly. In this example, a lateral expansion rib 38 is integrally formed on the inner side of the legs, in this case in the region of the bend.

Figure 8:
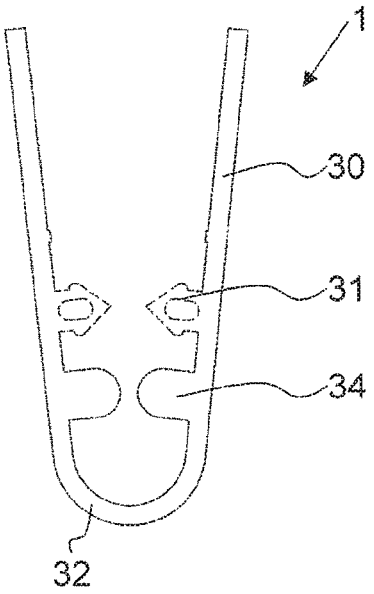
FIG. 8 shows a view of a seventh embodiment of a sealing profile according to the invention.
Figure 9:
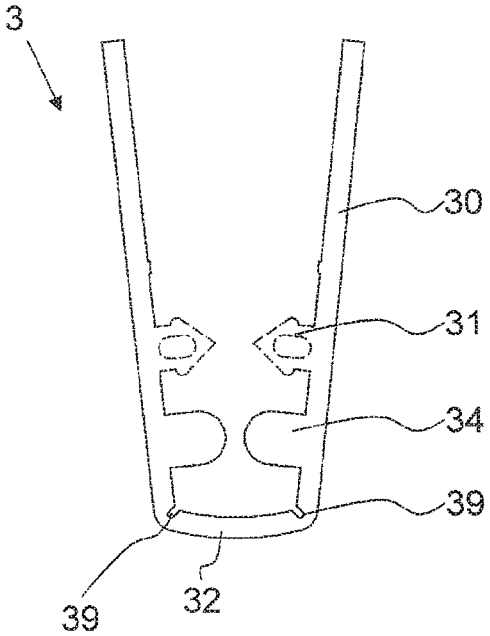
FIG. 9 shows a view of a sealing profile according to an eighth embodiment of the invention.

The sealing crosspiece 32 is of curved design. It is thinner than the adjoining region of the legs 30. The transition between leg 30 and sealing crosspiece 32 is formed, in this example, by a step 33. If, as illustrated in FIG. 8, there is no step present, the transition between leg and sealing crosspiece can be found wherever, at least with the seal in the sealing state resting on the floor, the substantially horizontal region of the sealing profile merges into the substantially vertical region of the sealing profile, or into that region of the latter which comprises a vertical part. This definition applies to all the exemplary embodiments in which the sealing crosspiece comprises a thickness which is substantially equal to the thickness of the adjacent region of the legs. The transition in the variant according to FIG. 9 is formed by a notch or a tapering 39 of the sealing profile 3 between leg 30 and sealing crosspiece 32.

The legs 30 comprise, in this example, the same thickness over their entire length. The sealing crosspiece 32 is also designed to be of the same thickness over its entire length.

A fastening rib 31 is integrally formed on the inner sides of each leg 30. Said rib comprises, in this example, a Christmas-tree-like structure. Said fastening rib 31 engages in the undercut receiving groove 22 directed toward it, as a result of which the sealing profile 3 is fastened on either side of the carrier profile 2. The carrier profile 2 and sealing profile 3 can thus be raised and lowered together relative to the housing rail 1.

At least one of the two legs 30 comprises at least one strip 34 beneath the fastening ribs 31 and at a distance from the same. In this example, one such strip 34 is integrally formed on each leg 30. It is preferably formed in one piece with the rest of the sealing profile. It preferably consists of the same material as the rest of the sealing profile. The two strips 34 are preferably situated at the same height and consequently are located opposite one another.

The entire sealing profile 3 is preferably produced from the same material and does not comprise any zones of a different density. At least that region of the sealing profile 3 which is adjacent to the strip 34 is preferably produced from the same material and with the same density. There are preferably no other materials incorporated or added. In other embodiments, however, there are such differences present in respect of material or composition. The strip can also be attached by bonding or welding. The single-piece and integral embodiment of the sealing profile, however, is unequivocally preferred.

When the sealing profile 3 has been fastened on the carrier rail 2, the strips 34 are situated beneath the underside 23 of the carrier rail 2, but at a distance from the same. This applies to the non-loaded state, when the curved seal is not resting with sealing action on the floor. If it is resting with sealing action, one of the strips 34 is in contact with the carrier rail and the other strip is at a greater distance from the carrier rail than before. This takes place on account of the sliding movement of the sealing profile when the carrier rail is lowered during the operation of closing the door.

In addition, the strip 34 is situated, in this example, at a distance from the step 33, which leads to the sealing crosspiece 32.

The strips 34 are preferably significantly thicker than that region of the legs 30 which is adjacent to them and are preferably significantly thicker than the sealing crosspiece 32. The strips 34 are preferably at least twice as thick as, or many times thicker than, the sealing crosspiece 32. The thickness of the strips 34 (in FIG. 2 the height) is preferably 3 to 5 mm, in the case of a typical thickness of the sealing crosspiece 32 of 0.5 to 1.5 mm. The length of the strips 34 (in FIG. 2 the horizontal extent in the plane of the page of drawings) is preferably 4 to 6 mm.

The strips 34 extend into the cavity 37 preferably in a direction perpendicular to the longitudinal direction of the legs 30. Rather than extending as far as the transverse center axis Q of the seal, they preferably terminate before this. As a result, the two opposite strips 34 are not in contact with one another. The two opposite strips 34 preferably, as illustrated here, are of identical design and are arranged in a mirror-symmetrical manner with respect to one another. They are of solid, i.e. filled, design.

Each strip 34 comprises a substantially rectangular cross section, with a free rounded end 341.

FIGS. 8 and 9 illustrate variants of the sealing profile according to FIG. 1. The fastening ribs 31 are illustrated by dashed lines. This is intended to show that they may comprise a different shape in this variant and also in the other variants.

Figure 3:
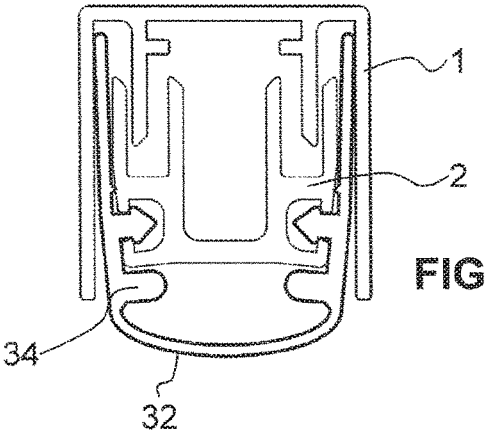
FIG. 3 shows a view of a second embodiment of a seal according to the invention.

In the embodiment according to FIG. 3, the housing rail 1 is formed differently in order to allow a different way of fastening the lowering mechanism and a reduction in the overall height of the seal. The sealing profile 3, however, is of similar design to the first exemplary embodiment, the legs 30 here being designed to be thicker in the region of the strips 34 than at the free end of the legs. The free end of the legs comprises a similar thickness to the sealing crosspiece 32. The strips 34 are arranged in the transition regions between leg 30 and sealing crosspiece 32. A separate step 33 is not present.

In this embodiment, the two strips 34 are designed to be of the same length as in the first example according to FIGS. 1 and 2. Since the seal, however, is designed to be wider, they do not project, as is the case in the first example, more or less as far as the middle of the cavity 37 or more or less as far as the transverse center axis Q. In this example, they terminate more or less half way to the transverse center axis Q or even earlier.

Figure 4:
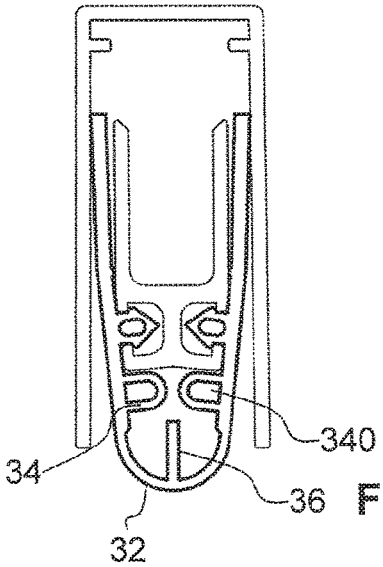
FIG. 4 shows a view of a third embodiment of a seal according to the invention.

In the embodiment according to FIG. 4, the two strips 34 are of hollow design. The corresponding cavity 340 is preferably filled with air. In addition, this example provides a partitioning element in the form of a rib 36, which is integrally formed centrally on the inner side of the sealing crosspiece 32 and projects upward into the cavity 37. Said rib 36 preferably terminates at a distance from the strips 34. Said rib 36 is preferably in contact with the strips 34 when they are in the lowered state resting on the floor. As a result, at least more or less closed individual chambers can form in the cavity. This increases the sound insulation. The rib 36 is preferably designed to be straight and is preferably at least as thick as the sealing crosspiece 32. Its thickness preferably corresponds more or less to the thickness of the legs 30. The rib 36 is preferably designed to be thick enough to be able to project upward independently. It preferably extends, with the seal in the non-loaded state, up to at least half way up the cavity 37. The rib 36 can be formed, like the strips 34, in one piece with the rest of the sealing profile and can consist preferably of the same material, without stiffening means. However, it can also be formed from some other material or in a stiffened manner and/or can be glued or welded to the sealing crosspiece 32 or connected thereto in some other way.

Figure 5:
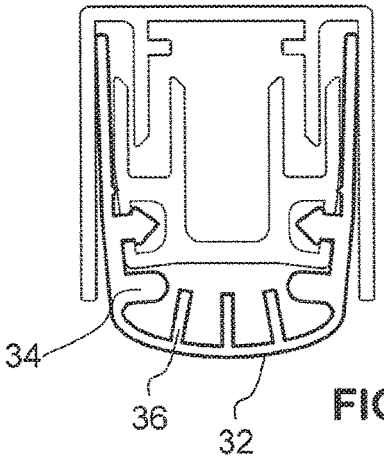
FIG. 5 shows a view of a fourth embodiment of a seal according to the invention.

The exemplary embodiment according to FIG. 5 presents three such ribs 36, which are arranged on the sealing crosspiece 32 at a distance from one another. In this example, they are designed to be of the same length. However, they can also be designed to be of different lengths. It is preferably the case that none of the three ribs establishes contact with the strips 34. In this example, however, they project into the intermediate region defined by the two strips 34.

In further embodiments which are not illustrated here, two, four or more ribs 36 are present.

Figure 6:
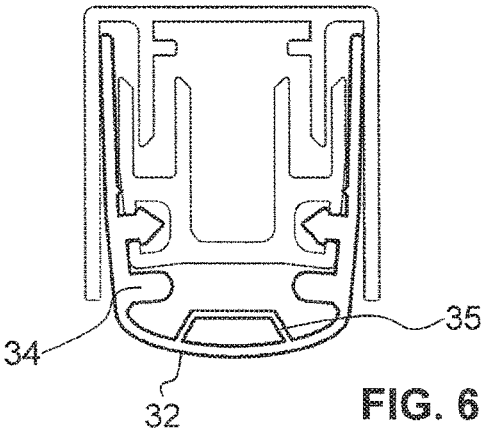
FIG. 6 shows a view of a fifth embodiment of a seal according to the invention.

In the exemplary embodiment according to FIG. 6, a crosspiece 35 is arranged on the sealing crosspiece 32, in the cavity 37, instead of the ribs 36, said crosspiece having both ends fastened or integrally formed on the sealing crosspiece 23. The crosspiece 35 preferably comprises three legs, which are angled in relation to one another. Together with the sealing crosspiece 32, they form a trapezoid with one rounded side. It is preferably also the case that the crosspiece 35 does not establish contact with the strips 34.

FIG. 7 shows a variant with a narrow seal, relatively short strips 34, which extend only more or less over half the distance to the transverse center axis Q, and with a crosspiece 35.

The individual features of the sealing profiles according to FIGS. 1 to 7 can also be combined together to form new variants. For example, sealing crosspieces 32 with and without partitioning elements can be combined with hollow strips 34 or the shape of the legs 30 and/or of the fastening ribs 31 can be changed.

The seal according to the invention exhibits surprisingly good sound insulation.

LIST OF REFERENCES

1 Housing rail
10 Side wall of the housing rail
11 Upper crosspiece
12 Protrusion
13 Groove
2 Carrier rail
20 Side wall of the carrier rail
21 Fastening body
22 Receiving groove
23 Underside
3 Sealing profile
30 Leg
31 Fastening rib
32 Sealing crosspiece
33 Step
34 Strip
340 Cavity
341 Free end
35 Crosspiece
36 Rib
37 Cavity
38 Lateral expansion rib
39 Tapering
Q Transverse center axis

The invention claimed is:

1. A seal for a sill-free door for sealing a gap between a door leaf and a floor, wherein the seal defines a transverse center axis, the transverse center axis extending in a vertical direction, wherein the seal comprises a carrier rail and a sealing profile which is held on the carrier rail, wherein the sealing profile comprises a substantially u-shaped cross section, the sealing profile comprising a first leg and a second leg and a sealing crosspiece, the first leg, the second leg and the sealing crosspiece defining an outer shape of the substantially u-shaped cross-section, wherein the crosspiece connects the first leg and the second leg together and is capable of resting with sealing action on the floor, wherein a cavity is present and is defined by an underside of the carrier rail, the first leg and the second leg and the sealing crosspiece, and wherein the sealing profile comprises at least one first strip on the first leg and at least one second strip on the second leg, wherein the at least one first strip is arranged on an inner side of the first leg and the at least one second strip is arranged on the second leg and wherein the at least one first strip and the at least one second strip project into the cavity, for the purpose of improving sound insulation, wherein at least two strips of the group of the at least one first strip and the at least one second strip have a thickness which is greater than the thickness of a region of the first or second leg adjacent to the at least one first or second strip respectively and wherein at least one of said at least two strips comprises a substantially rectangular cross section, wherein one side of the rectangle is curved in the form of part of a circle, wherein said side forms a free end of said at least one of said at least two strips, said free end projecting into the cavity and wherein said at least one of said at least two strips extends into the cavity at an angle of 80° to 100° with respect to the transverse center axis.

2. The seal as claimed in claim 1, wherein at least one of the at least one first strip and the at least one second strip is spaced apart from the underside of the carrier rail.

3. The seal as claimed in claim 1, wherein the at least one first strip arranged on the first leg is arranged and designed in a mirror-symmetrical manner with respect to the at least one second strip arranged on the second leg along the transverse center axis of the seal.

4. The seal as claimed in claim 1, wherein at least one of the at least one first strip and the at least one second strip terminates at a distance from the transverse center axis of the seal.

5. The seal as claimed in claim 1, wherein all the strips arranged on the legs terminate at a distance from one another.

6. The seal as claimed in claim 1, wherein the sealing crosspiece is designed to be thinner than a region of the first leg being adjacent to said at least one first strip and wherein the sealing crosspiece is designed to be thinner than a region of the second leg being adjacent to said at least one second strip.

7. The seal as claimed in claim 1, wherein at least one of the at least one first strip and the at least one second strip is of hollow or solid design.

8. The seal as claimed in claim 1, wherein an outer side of the sealing crosspiece is free of protrusions or ribs which are directed downward in the direction of the floor.

9. The seal as claimed in claim 1, wherein the sealing crosspiece is of curved design.

10. The seal as claimed in claim 1, wherein the two legs merge into the sealing crosspiece by way of a tapering step in each case.

11. The seal as claimed in claim 1, wherein at least one partitioning element, which projects inward into the cavity, is arranged on the sealing crosspiece.

12. The seal as claimed in claim 11, wherein the partitioning element is at least one upwardly projecting rib.

13. The seal as claimed in claim 11, wherein the partitioning element is an angled crosspiece with two ends and two angles, wherein the two ends are arranged on the sealing crosspiece at a distance from one another.

14. The seal as claimed in claim 1, wherein the seal also comprises a housing rail, wherein the carrier rail and sealing profile form a sealing bar, and wherein said sealing bar is held in the housing rail such that it can be lowered and raised relative to the housing rail.

* * * * *